US008757725B2

(12) United States Patent
Schneider et al.

(10) Patent No.: US 8,757,725 B2
(45) Date of Patent: Jun. 24, 2014

(54) SEATING FURNITURE

(75) Inventors: Stefan Schneider, Untersiemau (DE); Johannes Welsch, Bamberg (DE)

(73) Assignee: ASS-Einrichtungssysteme GmbH, Stockheim (DE)

( * ) Notice: Subject to any disclaimer, the term of this patent is extended or adjusted under 35 U.S.C. 154(b) by 0 days.

(21) Appl. No.: 13/703,172

(22) PCT Filed: Aug. 10, 2011

(86) PCT No.: PCT/EP2011/063800
§ 371 (c)(1),
(2), (4) Date: Dec. 10, 2012

(87) PCT Pub. No.: WO2012/020071
PCT Pub. Date: Feb. 16, 2012

(65) Prior Publication Data

US 2013/0082505 A1 Apr. 4, 2013

(30) Foreign Application Priority Data

Aug. 10, 2010 (DE) ..... 10 2010 039 170

(51) Int. Cl.
*A47C 1/12* (2006.01)

(52) U.S. Cl.
USPC ..... 297/451.3; 297/445.1

(58) Field of Classification Search
USPC ..... 297/294, 451.3, 445.1, 285
See application file for complete search history.

(56) References Cited

U.S. PATENT DOCUMENTS 2,098,888 A * 11/1937 Schadler ..... 297/239
2,981,315 A * 4/1961 Schaffer ..... 297/287
3,332,718 A * 7/1967 Reinhold ..... 297/288

(Continued)

FOREIGN PATENT DOCUMENTS

AT 128771 6/1932
DE 1923564 9/1965

(Continued)

OTHER PUBLICATIONS

International Search Report dated Nov. 7, 2011, issued in corresponding International Application No. PCT/EP2011/063800.

(Continued)

*Primary Examiner* — Milton Nelson, Jr.
(74) *Attorney, Agent, or Firm* — Stein IP, LLC

(57) ABSTRACT

A piece of seating furniture, particularly a chair with a resilient frame which, from the side view, is substantially configured Z-shaped and which includes an upper part of the frame, two lower parts of the frame and two middle parts of the frame, each connecting the lower part of the frame with the upper part of the frame. The middle parts of the frame each reach from the respective lower part of the frame in the rear area of a seat surface upwards at an angle to the upper part of the frame in the front area of the seat surface. The distance of the middle parts of the frame to one another at the upper part of the frame is up to a maximum of half, preferably up to a maximum of one third of the width of the seat surface in the front area. Thus, the piece of seating furniture which is particularly easy to stack, enables a large legroom for a person sitting on the piece of seating furniture and wherein the seat surface can be rocked towards the left and the right.

14 Claims, 4 Drawing Sheets

(56) References Cited

U.S. PATENT DOCUMENTS

| | | | | | |
|---|---|---|---|---|---|
| 3,746,394 | A | * | 7/1973 | Speidel | 297/452.14 |
| 4,618,185 | A | * | 10/1986 | Kaufman | 297/285 |
| 4,787,672 | A | * | 11/1988 | Werner | 297/296 |
| 7,147,284 | B2 | * | 12/2006 | Mills et al. | 297/271.5 |
| D683,572 | S | * | 6/2013 | Weber et al. | D6/716.3 |
| 2008/0100120 | A1 | | 5/2008 | Fletcher et al. | |

FOREIGN PATENT DOCUMENTS

| | | | |
|---|---|---|---|
| DE | 93 00 705 | | 11/1993 |
| DE | 9300705.1 | | 11/1993 |
| DE | 20 2009 003927 | | 6/2009 |
| EP | 1 897 467 | | 3/2008 |
| WO | WO2009007889 | A1 * | 7/1990 |

OTHER PUBLICATIONS

PCT/IB/338 for PCT/EP2011/063800; Mailed Feb. 21, 2103; 1 page.
PCT/IB/373 for PCT/EP2011/063800; Issued Feb. 12, 2013; 1 page.
PCT/ISA/237 for PCT/EP2011/063800; 5 pages.

* cited by examiner

SEATING FURNITURE

CROSS-REFERENCE TO RELATED APPLICATIONS

This application is a national stage application of PCT Application No. PCT/EP2011/063800, filed Aug. 10, 2011, which claims the benefit of German Application No. 10 2010 039 170.0, filed Aug. 10, 2010.

BACKGROUND OF THE INVENTION

1. Field of the Invention

The invention relates to a piece of seating furniture, particularly a chair with a resilient frame, onto which a seat surface can be arranged.

2. Description of the Related Art

Seating furniture, particularly chairs, with a resilient frame are known from prior art as so-called cantilever chairs. A cantilever chair is a chair without rear chair legs, wherein its seat surface resiliently gives under the weight of a person and slightly subsides towards the back. A cantilever chair comprises a supporting frame, wherein the parts of the frame forming the front chair legs are each bent towards the back at the top and at the bottom. At the bottom, the frame runs from the ground to the rear edge of the chair, respectively. At the top, the frame runs parallel to the frame parts reaching from the ground to the rear edge of the chair, respectively, wherein the two sides of the frame are also in parallel to one another. From the side view, the frame of such a cantilever chair is substantially U-shaped. The upper parts of the frame serve as support for the seat, wherein the upper parts of the frame are substantially parallel to one another and wherein the seat surface is substantially arranged between the two upper parts of the frame.

A modification of such a cantilever chair is known from AT 128771, wherein the two upper parts of the frame are not connected with the front bottom parts but with the rear bottom parts of the frame so that, from the side view, the frame of this cantilever chair substantially comprises a Z-shape.

The cantilever chairs known from prior art have the disadvantage that the seat surface is resilient towards the back but swaying in lateral direction is not possible. Another disadvantage, particularly of the U-shaped cantilever chairs, is that they are not perfectly stackable due to the configuration of the frame.

SUMMARY OF THE INVENTION

Thus, the invention is based on the problem to provide a piece of seating furniture, particularly a chair, with a resilient frame, without having to put up with the disadvantages known from prior art and which particularly enables an enhanced mobility also towards the side as well as an improved stackability of the seating furniture.

According to the present invention, this object is achieved by a piece of seating furniture, particularly a chair, with a resilient frame according to the independent claim. Advantageous embodiments of the invention are referred to in the respective dependent claims.

The present invention provides a piece of seating furniture, particularly a chair with a resilient frame which, from the side view, is substantially configured Z-shaped and which comprises an upper part of the frame, two lower parts of the frame and two middle parts of the frame, each connecting a lower part of the frame with the upper part of the frame. The upper part of the frame reaches from a rear area of a seat surface which can be arranged at the upper part of the frame to a front area of the seat surface. The lower parts of the frame form skids at least partially running parallel to the seat surface and from the front area of the seat surface to the rear part of the seat surface. The middle parts of the frame each reach from the respective lower part of the frame in the rear area of the seat surface upwards at an angle to the upper part of the frame in the front area of the seat surface, wherein according to a preferred embodiment, the lateral distance of the middle parts of the frame to the upper part of the frame and thus towards the seat surface decreases. The distance of the middle parts of the frame to one another at the upper part of the frame is up to a maximum of two thirds, preferably up to a maximum of half of the width of the seat surface in the front area in order to at least partially enable a lateral, ergonomically advantageous movement of the upper part of the frame with regard to the lower parts of the frame when using the piece of seating furniture, without the lower parts of the frame considerably lifting off the ground.

Due to the small distance of the middle parts of the frame to one another according to the present invention in the area of the upper part of the frame, thus in the area of the seat, a rocking of the seating to the right side and to the left side is enabled, which makes sifting particularly comfortable. Since the Z-shaped embodiment also enables a rocking to the back and to the front, the seat surface can be rocked in almost any direction. The substantially Z-shaped embodiment of the frame being convergent towards the top results in an enhanced stackability of the piece of seating furniture, since the middle parts of the frame are not directly one in front of the other when stacked (as with cantilever chairs known from prior art) but they rather partially overlap. This leads to a certain self-centering of the stacked seating furniture. Furthermore, the overlapping ensures that upper piece of seating furniture in case of two stacked pieces of seating furniture is not, as in prior art, displaced towards the front by at least the thickness of the middle part of the frame, but is only displaced by a fractional amount of this thickness. Thus, more pieces of seating furniture can be stacked until the stack becomes instable, since with increasing height the center of gravity moves towards the front. The middle parts of the frame each reach from the respective lower part of the frame in the rear area of a seat surface upwards at an angle to the upper part of the frame in the front area of the seat, thus furthermore achieving a particularly good free moving space around the legs and feet.

In an embodiment of the piece of seating furniture according to the present invention, the distance of the middle parts of the frame to one another at the upper part of the frame can be up to a maximum of one third of the width of the seat surface in the front area. This way, a rocking of the seat surface to the left and to the right side can be further enhanced.

According to an embodiment of the invention, the lower parts of the frame can substantially be parallel to one another.

The upper part of the frame can substantially be trapezoidal and becomes broader towards the rear area of the seat surface so that a stable arrangement of the seat surface is ensured at the upper part of the frame. According to an embodiment of the invention, a connecting member can be arranged at the upper part of the frame in the front area of the seat surface, wherein the connecting member is inclined towards the surface formed by the upper part of the frame. On the one hand, the connecting member can be provided to increase the stability of the frame in the upper area; on the other hand, the connecting member can be used to connect the seat surface to the frame.

Preferably, the connecting member comprises a fixing device so that arm rests and/or writing tablets can be attached to the connecting member.

It has shown to be advantageous to provide an opening at the bottom side of the seat, into which the portion of the upper part of the frame in the rear area of the seat surface can at least partially be arranged in a form-fitting manner. It has also shown to be advantageous to provide a stable surface at the bottom side of the seat surface corresponding with the connecting member, wherein the seat surface can be connected to the connecting member at said stable surface. A force can be applied in case of a connection, preferably a bolted connection, of the stable surface with the connecting member, tightening the portion of the upper part of the frame arranged in the opening against the opening. This way, the seat surface can be connected to the frame in a particularly simple way while at the same time ensuring a high stability of the seat surface on the frame.

Preferably, the frame can be formed in one part.

Preferably, the frame comprises metal, preferably steel, wherein the frame comprises a round, preferably circular profile. According to another embodiment of the invention, the frame may also comprise durable plastics.

Across member may be provided between the lower parts of the frame but also in the middle part of the frame, which connects the lower parts of the frame to one another. The cross member is preferably arranged in the middle or in the rear area of the lower parts of the frame. This way, the stability of the frame is further increased.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
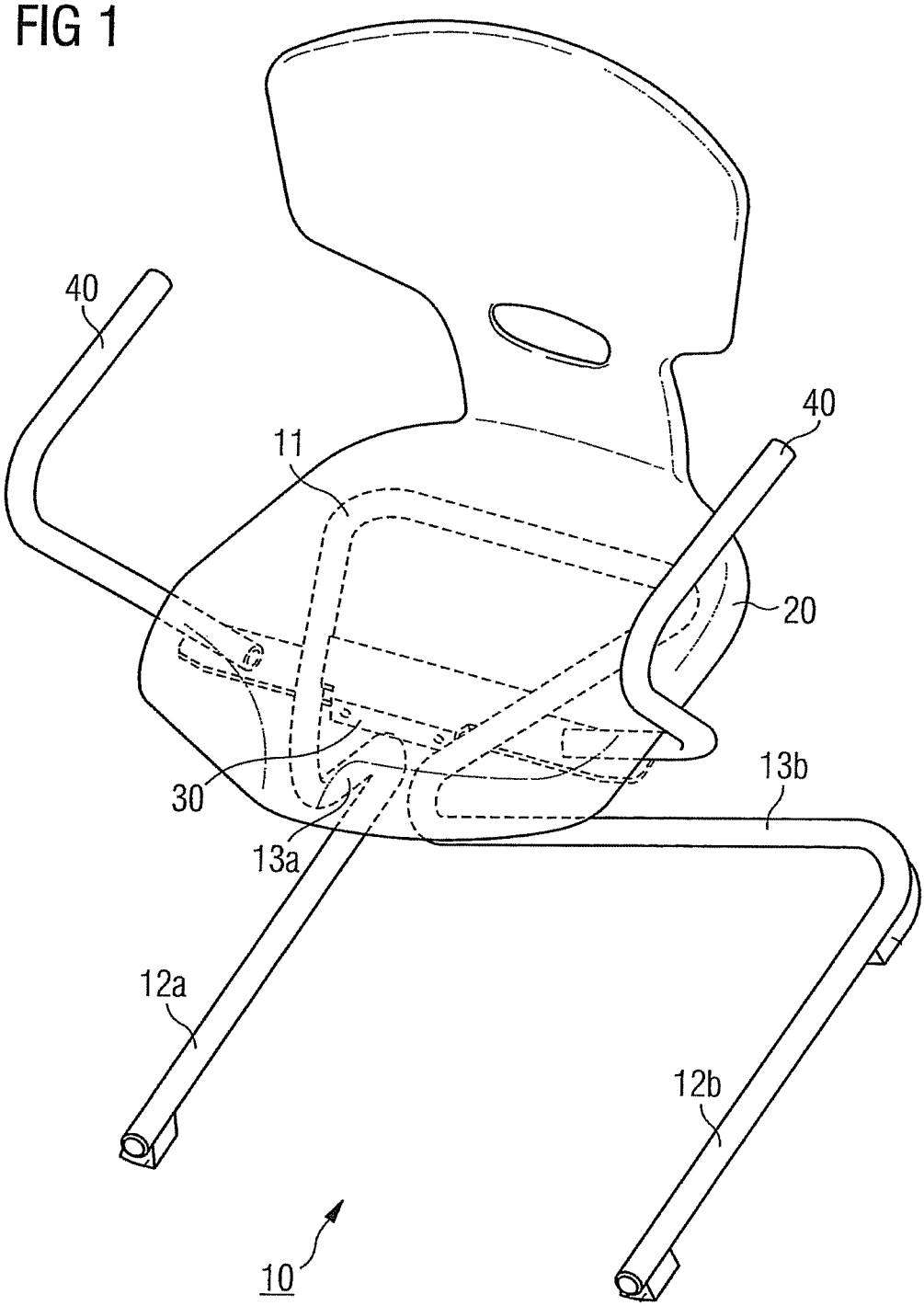
FIG. 1 a frame of a piece of seating furniture according to the present invention in an isometric view, wherein the seat surface is only illustrated in outlines.

Reference will now be made in detail to the present embodiments of the present invention, examples of which are illustrated in the accompanying drawings, wherein like reference numerals to the like reference numerals refer to the like elements throughout. The embodiments are described below in order to explain the present invention by referring to the figures.

FIG. 1 shows a piece of seating furniture according to the present invention, in this illustration a chair, with a resilient frame 10. The frame 10 comprises an upper part of the frame 11, two lower parts of the frame 12*a*, 12*b* and two middle parts of the frame 13*a*, 13*b*, each connecting a lower part of the frame 12*a*, 12*b* with the upper part of the frame 11. From the side view, the frame substantially comprises a Z-shape. The Z-shaped embodiment of the frame can be seen particularly well in the side view of FIG. 3. The middle parts of the frame 13*a*, 13*b* each reach from the respective rear, laterally outer area of the lower part of the frame 12*a*, 12*b* upwards at an angle to the upper part of the frame 11 in the front area of the seat surface 20, where their lateral distance is smaller. The stability of the frame 10 is given even without front chair legs since the force due to the weight of a person sitting down on the piece of seating furniture is transferred via the stress in the middle parts of the frame 13*a*, 13*b* backwards at an angle to the lower parts of the frame 12*a*, 12*b*.

The Z-shaped embodiment of the frame 10 enables a rocking to the back as well as a rocking to the front without the skid-shaped lower parts of the frame 12*a*, 12*b* being lifted.

The middle parts of the frame 13*a*, 13*b* converge towards the upper part of the frame 11 so that the distance of the middle parts of the frame 13*a*, 13*b* to one another in the front area of the seat surface 20 is smaller than in the rear area of the seat surface 20, that is where the middle parts of the frame 13*a*, 13*b* meet the lower parts of the frame 12*a*, 12*b*. The converging of the middle parts of the frame towards the upper part of the frame 11 can be seen particularly well in FIG. 4 and is described in detail with reference to FIG. 4. These middle parts of the frame 13*a*, 13*b* converging in the front area of the seat surface furthermore ensure that the seat surface 20 can be slightly rocked to the left and to the right side which can be easily caused by shifting of weight of a person sitting on the chair to the left or to the right side. Since the distance of the lower parts of the frame 12*a*, 12*b* to one another substantially corresponds to the width of the seat surface 20 (cf. also FIG. 4), the chair is sufficiently stable, that is the chair is prevented from tipping over despite the possibility to rock the seat surface to the left and to the right side. Due to the lateral flexibility in the upper area achieved by this, a lateral rocking does not lead to a lifting of one of the skids off the ground that quickly as it would be the case with a laterally rigid system, that is also in case of a cantilever chair known from prior art.

The upper part of the frame 11 is configured trapezoidally and becomes broader towards the rear area of the seat surface 20. This way, it is ensured that the seat surface 20 can be attached to the upper part of the frame 11 in a stable manner.

A cross member can be provided between the lower parts of the frame 12*a*, 12*b* and/or the middle parts of the frame 13*a*, 13*b* in order to increase the stability of the frame (not shown here). Preferably, the cross member is arranged in the rear area of the lower parts of the frame 12*a*, 12*b*. It substantially prevents the lower parts of the frame from moving against each other in case of load.

The upper part of the frame 11 can substantially also comprise a rectangular or circular embodiment instead of a trapezoidal embodiment.

The lower parts of the frame 12*a*, 12*b* substantially run parallel to the seat surface 20 and comprise protectors for the floor at the front end and at the rear end, respectively. The two lower parts of the frame 12*a*, 12*b* can be configured as skids, respectively, wherein the skids can comprise an upward bending in the front area and in the rear area and are substantially straight in the middle area. A piece of seating furniture, wherein the lower parts of the frame 12*a*, 12*b* are formed as skids is used for normal sitting in the middle, straight area, whereas the piece of seating furniture follows the movement of the user when leaning forward or backward.

Arm rests 40 are attached to the upper part of the frame 11, being guided outwards below the seat surface and thus project over the sides of the seat surface 20 and are then guided upwards next to the sides of the seat surface 20. As an alternative, a writing pad or a writing tablet can be attached to one of the arm rests 40, wherein it is preferably configured in such a way that it can be pivoted.

Figure 2:
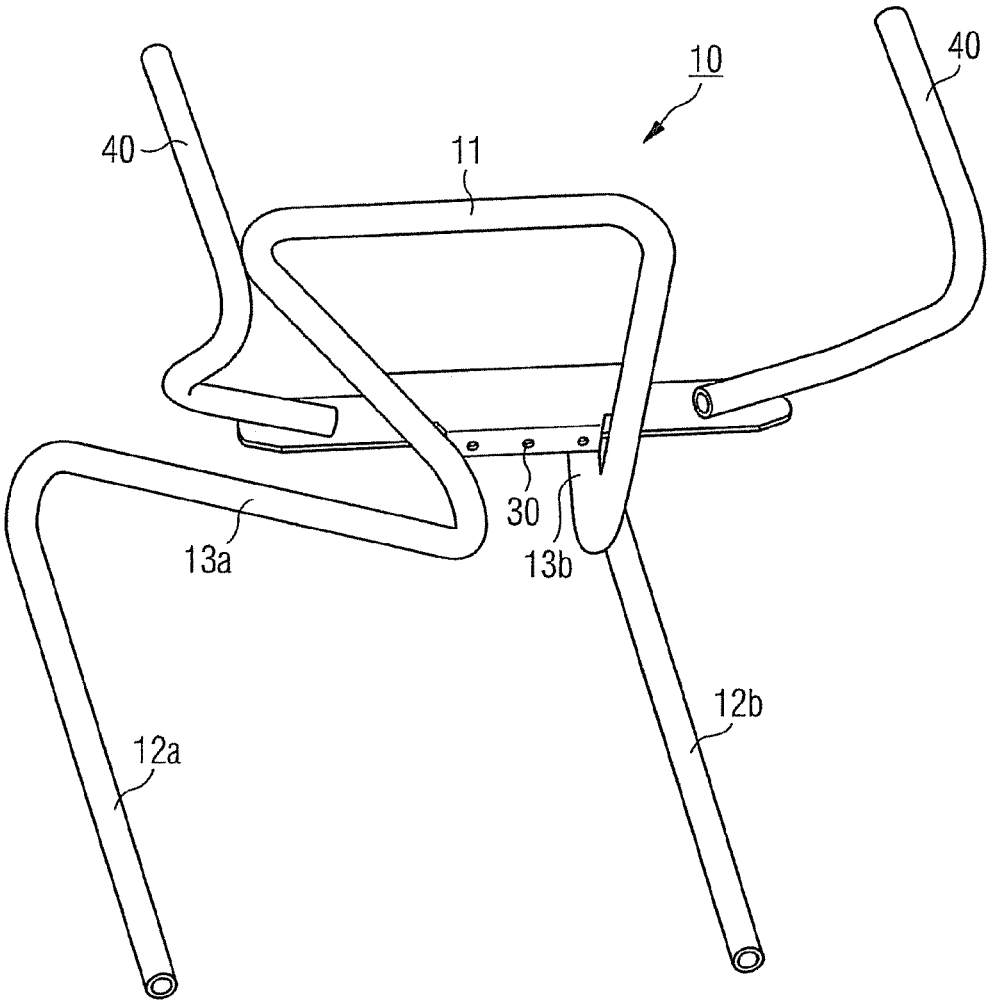
FIG. 2 the frame of a piece of seating furniture according to the present invention in an isometric view with arm rests attached to the frame.

FIG. 2 shows a frame of a piece of seating furniture according to the present invention in an isometric view with arm rests attached to the frame. A connecting member 30 is arranged in the front area of the substantially trapezoidal upper part of the frame 11, wherein the connecting member is firmly attached to the upper part of the frame 11. The connecting member 30 or a portion of the connecting member 30 is inclined towards the surface formed by the upper part of the frame 11. The inclined portion of the connecting member 30 is provided to connect the seat surface 20, for instance, by means of a bolted connection with the frame 10. Furthermore, the fixing device 30 can also be provided to increase the stability of the frame in the upper area.

Furthermore, the connecting member comprises a fixing device so that arm rests and/or writing tablets or writing pads can be attached to the connecting member. As can be seen from FIG. 2, a plate can be attached to the connecting member substantially projecting over the sides of the upper part of the frame. An arm rest 40 can be attached to each of the projecting parts. Furthermore, the arm rests 40 can be attached to the plate in such a way that they can, for instance, be pivoted forward into the area below the seat surface. In case of pivotally arranged arm rests 40, an additional locking mechanism can be provided in order to lock the arm rest 40 in place when being used.

Figure 3:
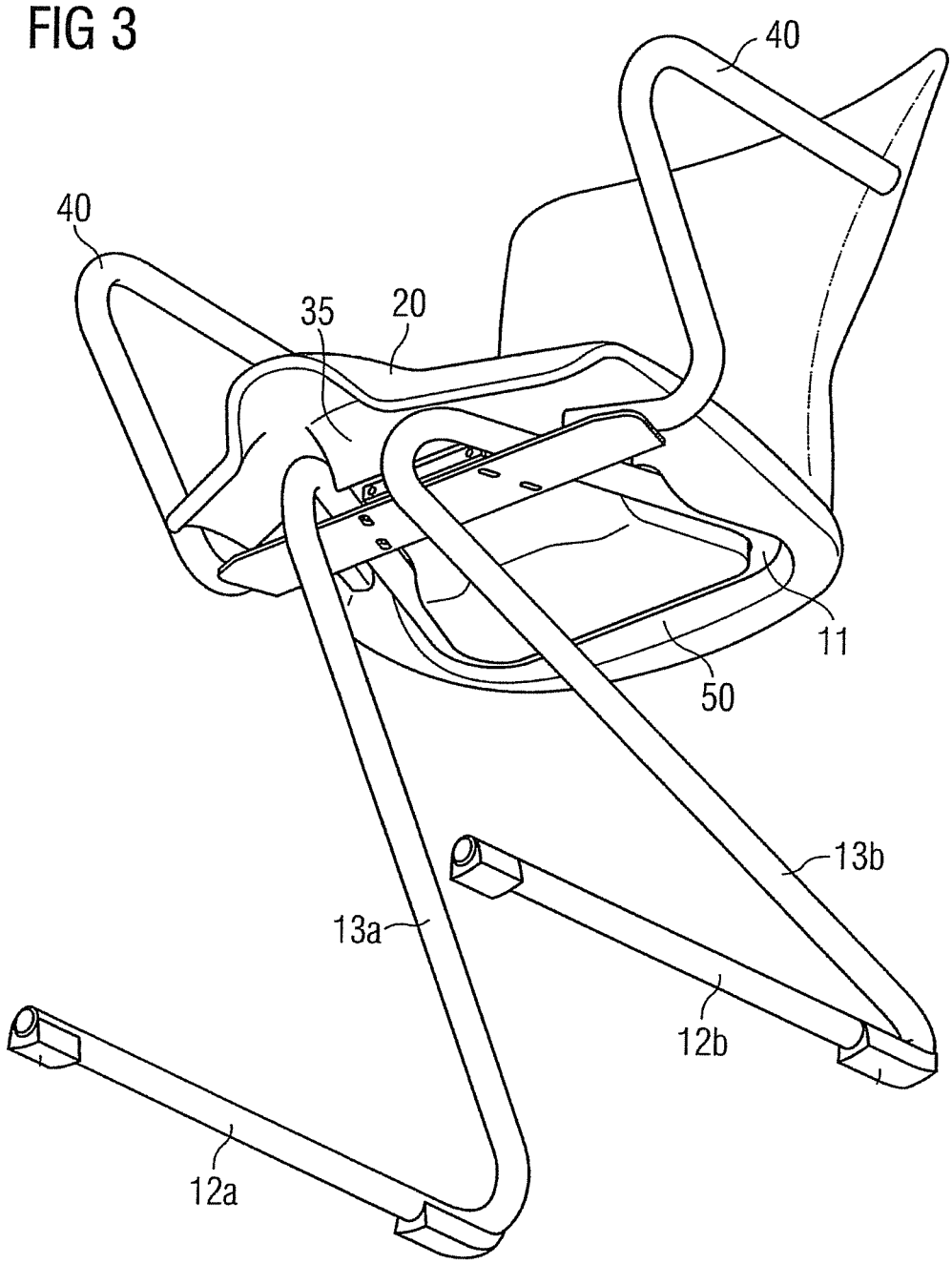
FIG. 3 a piece of seating furniture according to the present invention in an isometric view from below in order to illustrate the configuration of the seat surface at the frame.

FIG. 3 shows a piece of seating furniture according to the present invention in an isometric view substantially from below. The frame which is, from the side view, substantially configured in a Z-shape is clearly visible in this figure.

The seat surface 20 comprises an opening or a recess 50 in the rear area, into which the substantially trapezoidal portion of the upper part of the frame in the rear area of the seat surface 20 can be arranged in a form-fitting manner. The front area of the seat surface 20 comprises a stable surface 35 at the bottom side, at which the seat surface 20 can be connected with the connecting member 30. Preferably, the stable surface 35 corresponds with the inclined surface of the connecting member 30. The inclined surface may comprise several bore holes for connecting the frame with the seat surface 20 in order to bolt together the connecting member 30 and the seat surface 20.

The stable surface 35 together with the opening or recess 50 enables a particularly simple but still secure connection of the seat surface 20 and the frame 10. In case of a bolted connection of the stable surface 35 with the connecting member 30, a force is applied, tightening the portion of the upper part of the frame 11 arranged in the opening or recess 50 against the opening or recess 50. The opening 50 preferably comprises a recess along the front side wall, into which the frame portion arranged in the opening 50 is pulled when connecting the stable surface 35 with the connecting member 30. This way, the rear area of the seat surface 20 is simultaneously prevented from being pivoted upwards from the frame 11. Furthermore, the mounting of the piece of seating furniture is considerably simplified since, ultimately, only the stable surface 35 must be connected to the connecting member 30.

The opening 50 can also reach from the side of the bottom side of the seat surface 20 to the front area of the seat surface 20 so that also the side portions of the substantial trapezoidal upper part of the frame can be preferably arranged in the opening 50 in a form-fitting manner. This prevents the seat surface 20 from shifting in lateral direction.

The stable surface 35 or the connecting member 30 may also provide pins instead of bolted connections to connect the stable surface 35 to the connecting member 30, wherein each of the pins can snap into place in the respective openings of the connecting member 30 or of the stable surface 35. This way, the seat surface can be connected to the frame without requiring any bolted connections or tools. The seat surface 20 with its opening 50 can then be fitted in the rear area of the trapezoidal upper part of the frame 11. The seat surface 20 or the stable surface 35 arranged at the bottom side of the seat surface 20 can then be pressed against the connecting member 30 until the pins snap into place in the respective openings. A subsequent disconnecting of the seat surface 20 from the frame can be ensured by a certain flexibility of the stable surface 35 in order to remove the pins from the corresponding openings.

Figure 4:
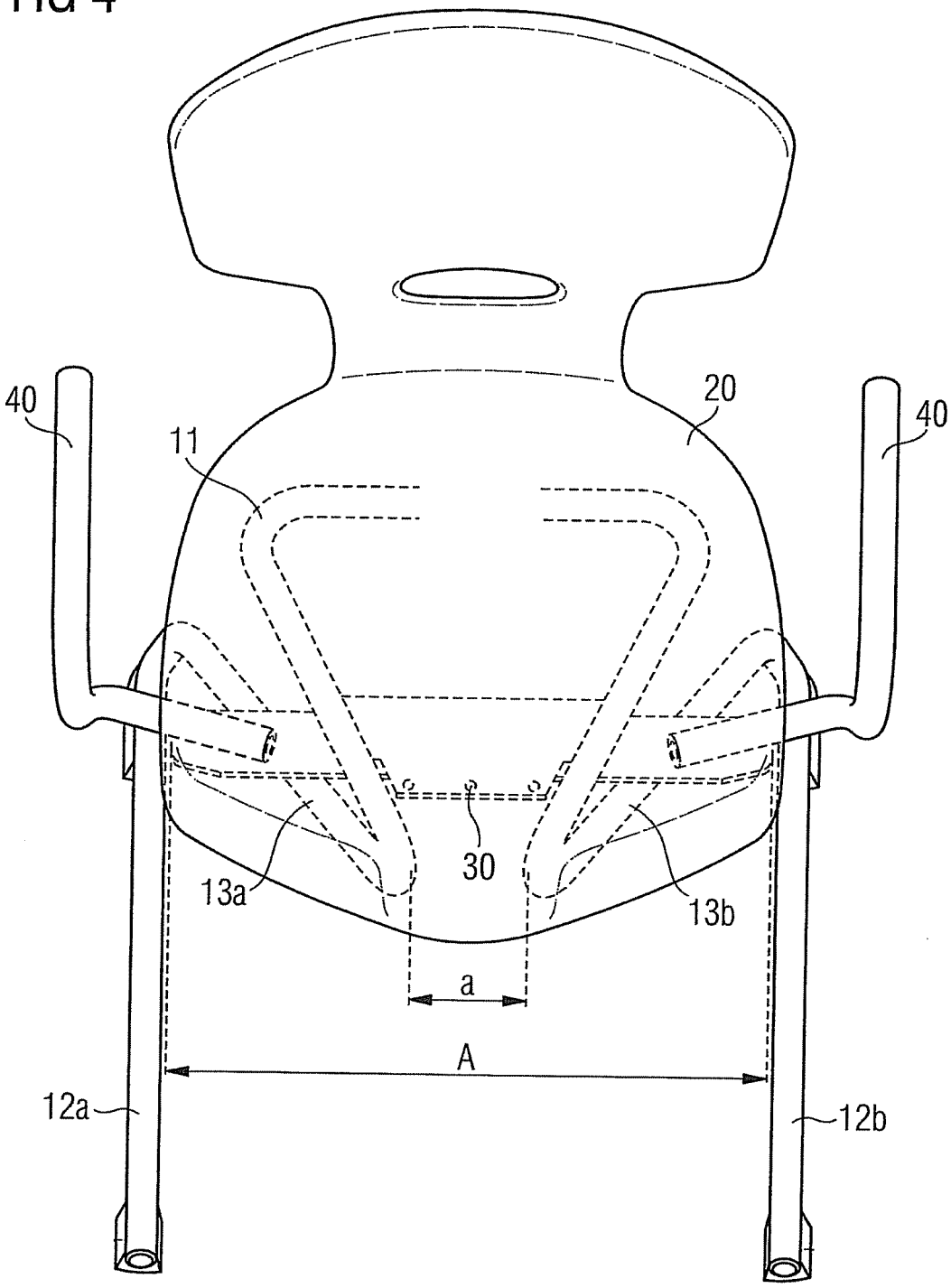
FIG. 4 the piece of seating furniture according to the present invention in a view from above, wherein the seat surface is only illustrated in outlines.

FIG. 4 shows a piece of seating furniture according to the present invention in a view from above, wherein the seat surface 20 is only illustrated in outlines.

As can be clearly seen from FIG. 4, the distance a of the middle parts of the frame 13*a*, 13*b* to one another in the front area of the seat surface 20 is smaller than the width A of the seat surface 20 in the front area of the seat surface 20. It is particularly advantageous when the distance a is up to a maximum of half the width. It has shown to be particularly advantageous to select the distance a between the two middle parts of the frame 13*a*, 13*b* in the front area of the seat surface 20 in such a way that it is up to a maximum of one third of the width A of the seat surface 20 in the front area. This enables a rocking of the seat surface to the left and to the right side which can be caused by simply shifting the weight to the left or to the right side.

As can be seen from FIG. 4, the distance of the middle parts of the frame 13*a*, 13*b* to one another in the lower area, that is where the middle parts of the frame meet the lower parts of the frame 12*a*, 12*b*, is considerably broader than the distance a of the middle parts of the frame in the front area of the seat surface 20. This way, a particularly good stackability of the piece of seating furniture according to the present invention is achieved, wherein the middle parts of the frame getting narrower towards the top support a certain centering of the seating furniture to be stacked.

The frame shown here in the embodiment is formed in one part, wherein the frame comprises metal, preferably steel, and wherein the frame comprises a round, preferably circular profile.

In another embodiment not shown here, the frame can also be formed in several parts. For example, the frame can be formed in two parts, wherein the right part and the left part of the frame each form a part of the frame formed in two parts. The frame may also comprise durable plastics instead of metal. Furthermore, the frame may also comprise another suitable profile.

The seat surface 20 arranged at the upper part of the frame may comprise plastics or wood. The upper side of the seat surface 20 may also comprise a seat upholstery. The arm rests 40 may also comprise an upholstery.

Although a few embodiments of the present invention have been shown and described, it would be appreciated by those skilled in the art that changes may be made in this embodiment without departing from principles and spirit of the invention, the scope of which is defined in the claims and their equivalents.

The invention claimed is:

1. A piece of seating furniture, particularly a chair with a resilient frame which, from the side view, is substantially configured Z-shaped and which comprises an upper part of the frame, two lower parts of the frame and two middle parts of the frame, each connecting a lower part of the frame with the upper part of the frame, wherein the upper part of the frame reaches from a rear area of a seat surface which can be arranged to the upper part of the frame to a front area of the seat surface, the lower parts of the frame form skids at least partially running parallel to the seat surface and from the front area of the seat surface to the rear area of the seat surface, the middle parts of the frame each reach from the respective lower part of the frame in the rear area of the seat surface upwards at an angle to the upper part of the frame in the front area of the seat surface, and the distance of the middle parts of the frame to one another at the upper part of the frame is up to a maximum of half, of the width of the seat surface in the front area in order to at least partially enable a lateral, ergonomically advantageous movement of the upper part of the frame with regard to the lower parts of the frame when using the piece of seating furniture, without the lower parts of the frame considerably lifting off the ground.

2. A piece of seating furniture according to claim 1, wherein the distance of the middle parts of the frame to one another at the upper part of the frame is less than one quarter of the width of the seat surface in the front area.

3. A piece of seating furniture according to claim 1, wherein the middle parts of the frame converge from a rear outer position of the lower parts of the frame to a front middle position to the upper part of the frame.

4. A piece of seating furniture according to claim 1, wherein the lower parts of the frame are substantially parallel to one another.

5. A piece of seating furniture according to claim 1, wherein the upper part of the frame is substantially configured trapezoidal and becomes broader towards the rear area of the seat surface.

6. A piece of seating furniture according to claim 1, wherein a connecting member is arranged at the upper part of the frame in the front area of the seat surface, wherein a front area of the connecting member is inclined towards the surface formed by the upper part of the frame.

7. A piece of seating furniture according to claim 6, wherein the connecting member comprises a fixing device so that auxiliary equipment, particularly arm rests and/or writing tablets, can be attached to the connecting member.

8. A piece of seating furniture according to claim 1, wherein a bottom side of the seat surface comprises an opening, into which the portion of the upper part of the frame in the rear area of the seat surface can at least partially be arranged in a form-fitting manner.

9. A piece of seating furniture according to claim 8, wherein the bottom side of the seat surface comprises a stable surface corresponding with the connecting member, wherein the seat surface can be connected to the connecting member at the stable surface.

10. A piece of seating furniture according to claim 9, wherein a force is applied in case of a connection of the stable surface with the connecting member, tightening the part of the upper part of the frame arranged in the opening against the opening.

11. A piece of seating furniture according to claim 1, wherein the frame is formed in one part.

12. A piece of seating furniture according to claim 1, wherein the lower parts of the frame are connected by a cross member in the rear area of the seat surface.

13. A piece of seating furniture according to claim 1, wherein the middle parts of the frame are connected by a cross member.

14. A piece of seating furniture according to claim 1, wherein the frame comprises metal, and wherein the frame comprises a round profile.

* * * * *